US006254742B1

(12) United States Patent
Hanson et al.

(10) Patent No.: US 6,254,742 B1
(45) Date of Patent: Jul. 3, 2001

(54) DIFFUSER WITH SPIRAL OPENING PATTERN FOR AN ELECTROPLATING REACTOR VESSEL

(75) Inventors: Kyle M. Hanson, Kalispell; Robert A. Weaver, Whitefish; Jerry Simchuk; Raymon F. Thompson, both of Kalispell, all of MT (US)

(73) Assignee: Semitool, Inc., Kalispell, MT (US)

( * ) Notice: Subject to any disclaimer, the term of this patent is extended or adjusted under 35 U.S.C. 154(b) by 0 days.

(21) Appl. No.: 09/351,864

(22) Filed: Jul. 12, 1999

(51) Int. Cl.[7] ..... C25B 9/00; C25C 7/00; C25D 17/00

(52) U.S. Cl. ..... 204/279; 204/242; 204/275.1; 204/DIG. 7

(58) Field of Search ..... 204/242, 275.1, 204/279, DIG. 7; 205/148, 96, 123

(56) References Cited

U.S. PATENT DOCUMENTS

| | | | | |
|---|---|---|---|---|
| 4,113,577 | * | 9/1978 | Ross et al. | 205/123 |
| 4,469,566 | * | 9/1984 | Wray | 205/96 |
| 5,683,564 | * | 11/1997 | Reynolds | 205/68 |
| 6,080,288 | * | 6/2000 | Schwartz et al. | 204/224 R |
| 6,103,085 | | 8/2000 | Woo et al. . | |

* cited by examiner

*Primary Examiner*—Kathryn Gorgos
*Assistant Examiner*—Wesley A. Nicolas
(74) *Attorney, Agent, or Firm*—Perkins Coie LLP

(57) ABSTRACT

In an electroplating reactor for plating a spinning wafer, a diffusion plate is supported above an anode located within a cup filled with process fluid within the reactor. The diffusion plate includes a plurality of openings which are arranged in a spiral pattern. The openings allow for an improved plating thickness distribution on the wafer surface. The openings can be elongated slots curved along the direction of the spiral path.

19 Claims, 9 Drawing Sheets

DIFFUSER WITH SPIRAL OPENING PATTERN FOR AN ELECTROPLATING REACTOR VESSEL

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

In the production of semiconductor integrated circuits and other semiconductor articles from semiconductor wafers, it is often necessary to provide multiple metal layers on the wafer to serve as interconnect metallization which electrically connects the various devices on the integrated circuit to one another. Traditionally, aluminum has been used for such interconnects, however, it is now recognized that copper metallization may be preferable.

The semiconductor manufacturing industry has applied copper onto semiconductor wafers by using both a "damascene" electroplating process where holes, commonly called "vias", trenches and/or other recesses are formed onto a substrate and filled with copper and a patterned process where photoresist mask areas are not to be plated. In the damascene process, the wafer is first provided with a metallic seed layer which is used to conduct electrical current during a subsequent metal electroplating step. The seed layer is a very thin layer of metal which can be applied using one or more of several processes. For example, the seed layer of metal can be laid down using physical vapor deposition or chemical vapor deposition processes to produce a layer on the order of 1,000 angstroms thick. The seed layer can advantageously be formed of copper, gold, nickel, palladium, platinum, Pb/Sn Solders, or other metals. The seed layer is formed over a surface which is convoluted by the presence of the vias, trenches, or other recessed device features.

Wafers to be electroplated typically have an annular edge region which is free of seed layer metal. This edge region is referred to as "seed layer edge exclusion." The seed layer edge exclusion varies in width, measured radially on a wafer, from wafer to wafer depending on the process and apparatus used to deposit the seed layer.

After the seed layer has been applied, a copper layer is then electroplated onto the seed layer in the form of a blanket layer. The blanket layer is plated to an extent which forms an overlying layer, with the goal of providing a copper layer that fills the trenches and vias and extends a certain amount above these features. Such a blanket layer will typically be formed in thicknesses on the order of 8,000 to 15,000 angstroms (1–1.5 microns).

After the blanket layer has been electroplated onto the semiconductor wafer, excess metal material present outside of the vias, trenches, or other recesses is removed. The metal is removed to provide a resulting pattern of metal layer in the semiconductor integrated circuit being formed. The excess plated material can be removed, for example, using chemical mechanical planarization. Chemical mechanical planarization is a processing step which uses the combined action of a chemical removal agent and an abrasive which grinds and polishes the exposed metal surface to remove undesired parts of the metal layer applied in the electroplating step.

The electroplating of the semiconductor wafers takes place in a reactor assembly. In such an assembly an anode electrode is disposed in a plating bath, and the wafer with the seed layer thereon is used as a cathode. Only the lower face of the wafer, with seed layer, needs to contact the surface of the plating bath. The wafer is held by a support system that also conducts the requisite cathode current to the wafer. The support system may comprise conductive fingers that secure the wafer in place and also contact the wafer in order to conduct electrical current for the plating operation, or a perimeter ring contact with seal to define the plating area.

One embodiment of a reactor assembly is disclosed in U.S. Ser. No. 08/988,333, now U.S. Pat. No. 5,985,126, filed Sep. 30, 1997 entitled "Semiconductor Plating System Workpiece Support Having Workpiece—Engaging Electrodes With Distal Contact Part and Dielectric Cover," herein incorporated by reference. FIG. 1 illustrates such an assembly. As illustrated, the assembly 10 includes reactor vessel 11 for electroplating a metal, and processing head 12.

As shown in FIG. 1, the electroplating bowl assembly 14 includes a cup assembly 16 which is disposed within a reservoir chamber 18. Cup assembly 16 includes a fluid cup 20 holding the processing fluid for the electroplating process.

A bottom opening in the bottom wall 30 of the cup assembly 16 receives a polypropylene riser tube 34 which is adjustable in height relative thereto by a threaded connection between the bottom wall 30 and the tube 34. A fluid delivery tube 44 is disposed within the riser tube 34. A first end of the delivery tube 44 is secured by a threaded connection 45 to an anode 42. An anode shield 40 is attached to the anode 42 by screws 74. The anode shield serves to electrically isolate and physically protect the backside or the anode. It also reduces the consumption of organic plating liquid additives.

The delivery tube 44 supports the anode within the cup. The fluid delivery tube 44 is secured to the riser tube 34 by a fitting 50. The fitting 50 can accommodate height adjustment of the delivery tube 44 within the riser tube. As such, the connection between the fitting 50 and the riser tube 34 facilitates vertical adjustment of the delivery tube and thus the anode vertical position. The delivery tube 44 can be made from a conductive material, such as titanium or platinum plated titanium, and is used to conduct electrical current to the anode 42 as well as to supply fluid to the cup.

Process fluid is provided to the cup through the delivery tube 44 and proceeds therefrom through fluid outlet openings 56. Plating fluid fills the cup through the openings 56, supplied from a plating fluid pump (not shown).

An upper edge of the cup side wall 60 forms a weir which limits the level of electroplating solution or process fluid within the cup. This level is chosen so that only the bottom surface of the wafer W is contacted by the electroplating solution. Excess solution pours over this top edge into the reservoir chamber 18. The level of fluid in the chamber 18 can be maintained within a desired range for stability of operation by monitoring and controlling the fluid level with sensors, one or more outlet pipes, and actuators.

The processing head 12 holds a wafer W for rotation about a vertical axis R within the processing chamber. The processing head 12 includes a rotor assembly having a plurality of wafer-engaging fingers 89 that hold the wafer against holding features of the rotor. Fingers 89 are preferably adapted to conduct current between the wafer and a plating electrical power supply and act as current thieves. Portions of the processing head 12 mate with the processing bowl assembly 14 to provide a substantially closed processing volume 13.

The processing head 12 can be manipulated by a head operator as described in the aforementioned U.S. Ser. No. 08/988,333. Pivotal action of the processing head using the operator allows the processing head to be placed in an open or faced-up position (not shown) for loading and unloading wafer W.

Processing exhaust gas must be removed from the volume 13 as described in the aforementioned U.S. Ser. No. 08/988, 333.

A diffusion plate or "diffuser" 66 is provided above the anode 42 for providing a more controlled distribution of the fluid plating bath across the surface of wafer W. Fluid passages in the form of perforations are provided over all, or a portion of, the diffusion plate 66 to allow fluid communication therethrough. The height of the diffusion plate within the cup assembly is adjustable using threaded diffusion plate height adjustment mechanisms 70.

In the prior diffuser 66, the holes are arranged in an X-Y rectangular grid or in a diamond grid pattern. Some holes are then blocked off based on experimental optimization of the plating process to reduce non-uniformities in metallization thickness on the plated wafer.

One problem associated with the electroplating of wafers concerns the seed layer edge exclusion. The width of the seed layer edge exclusion is an important factor to be considered in optimizing the operating parameters and adjusting the apparatus of an electroplating reactor. Because the electroplating metal will not form on the seed layer edge exclusion, any change in width of the edge exclusion effectively changes the plating area of the wafer. This change must be compensated for in the electroplating operating parameters and components. Since the width of the edge exclusion can vary depending on the method and apparatus used to apply the seed layer, and the plating contact ring seal mechanics, the electroplating apparatus must be reset for different wafer edge exclusion. Different diffusers are typically used for wafers having different edge exclusions. For example, one diffusion plate is used for a 1 mm seed layer edge exclusion and another diffusion plate is used for a 2.5 mm seed layer edge exclusion.

As the microelectronics industry drives toward further miniaturization of microelectronic devices, it is advantageous to reduce non-uniformities to the greatest extent possible. The present inventors have recognized that it would be beneficial to arrange and configure a diffuser for an electroplating reactor to improve plating thickness distribution, to reduce non-uniformity of metallization, over the surface of a electroplated workpiece, such as a semiconductor wafer. The present inventors have recognized that it would be beneficial to configure a diffuser for an electroplating reactor which would be usable effectively with semiconductor wafers having differing seed layer edge exclusions, reducing the need to change out diffusers while still maintaining an acceptable low level of thickness non-uniformity of metal electroplated onto the seed layer.

BRIEF SUMMARY OF THE INVENTION

An improved diffusion plate or "diffuser" for an electroplating reactor, which is disposed in a process fluid below a spinning workpiece, such as a semiconductor wafer, is disclosed herein. The diffuser comprises a plate member having a plurality of openings through the plate member arranged in a spiral pattern. The spiral pattern provides a more constant "% open area" along the radius of the plate, given the frame of reference of a spinning workpiece, than prior diffusers. This spiral pattern decreases metallization non-uniformities on a plated workpiece. The invention will be described operating on a semiconductor wafer, although not limited to such a workpiece.

In the preferred embodiment of the diffuser, or "spiral diffuser," the openings are in the form of elongated and curved slots, curved along a spiral path. The spiral path of the embodiment preferably includes a plurality of continuous 360 degree turns around a center of the diffusion plate.

The spiral diffuser has the ability to improve the metallization thickness uniformity across the wafer, when compared with the x-y or diamond grid type diffuser. Additionally, the spiral diffuser is adaptable to be effectively used for wafers having a differing seed layer edge exclusion.

An improved reactor vessel is disclosed herein. The improved reactor vessel includes a reservoir container having a base with a surrounding container sidewall upstanding from the base. A cup is arranged within the container above the base, the cup having a bottom wall and a surrounding cup sidewall upstanding from the bottom wall, the cup sidewall defining a level of process fluid held within the cup. An anode is supported within the cup sidewall. A spiral diffuser is supported within the cup above the anode. The diffuser has a spiral pattern of openings. A reactor head holds and spins a wafer as a cathode within the container, above the diffuser.

The reactor vessel includes bayonet style connections between an anode assembly and the diffusion plate. The anode assembly includes an anode shield that carries the anode. A plurality of brackets, preferably formed as a unitary structure with the anode shield, extend upwardly from the anode. The diffusion plate is connected to the plurality of brackets by a bayonet connection at each bracket.

Alternatively, a mounting ring can be connected by bayonet connections to the brackets and the diffusion plate held at a position within the mounting ring. The position can be a selectable one of a plurality of positions at varying elevations. The elevation of the diffusion plate relative to the top of the cup and the top of the anode is an important process parameter. The selectable positioning of the diffusion plate within the mounting ring allows easier diffuser position adjustment within the reactor vessel.

Numerous other advantages and features of the present invention will become readily apparent from the following detailed description of the invention and the embodiments thereof, from the claims and from the accompanying drawings in which details of the invention are fully and completely disclosed as part of this specification.

DETAILED DESCRIPTION OF THE INVENTION

Figure 1:
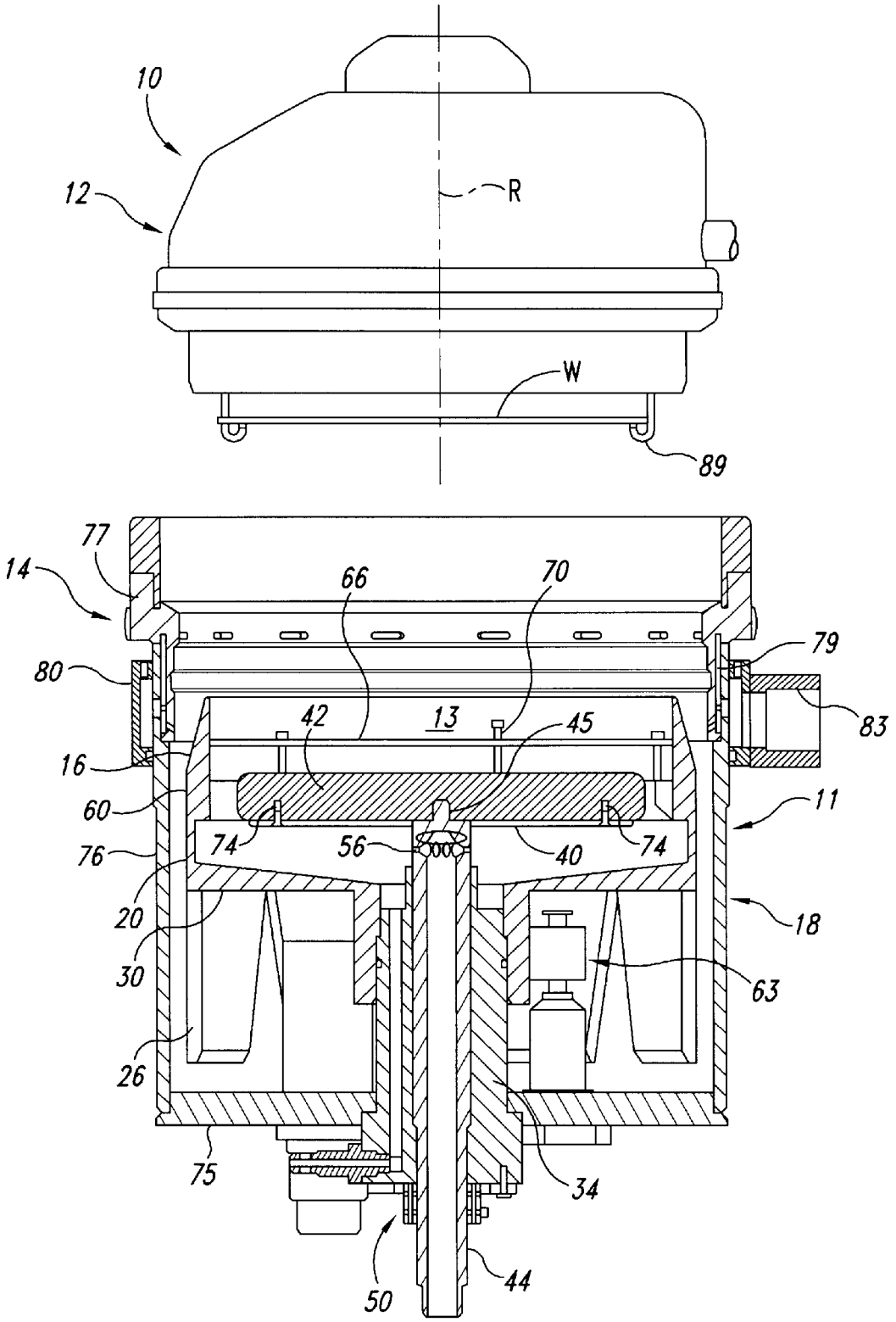
Fig. 1 (Prior Art)
FIG. 1 is an exploded partially sectional view of a reactor vessel and processing head.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Figure 2:
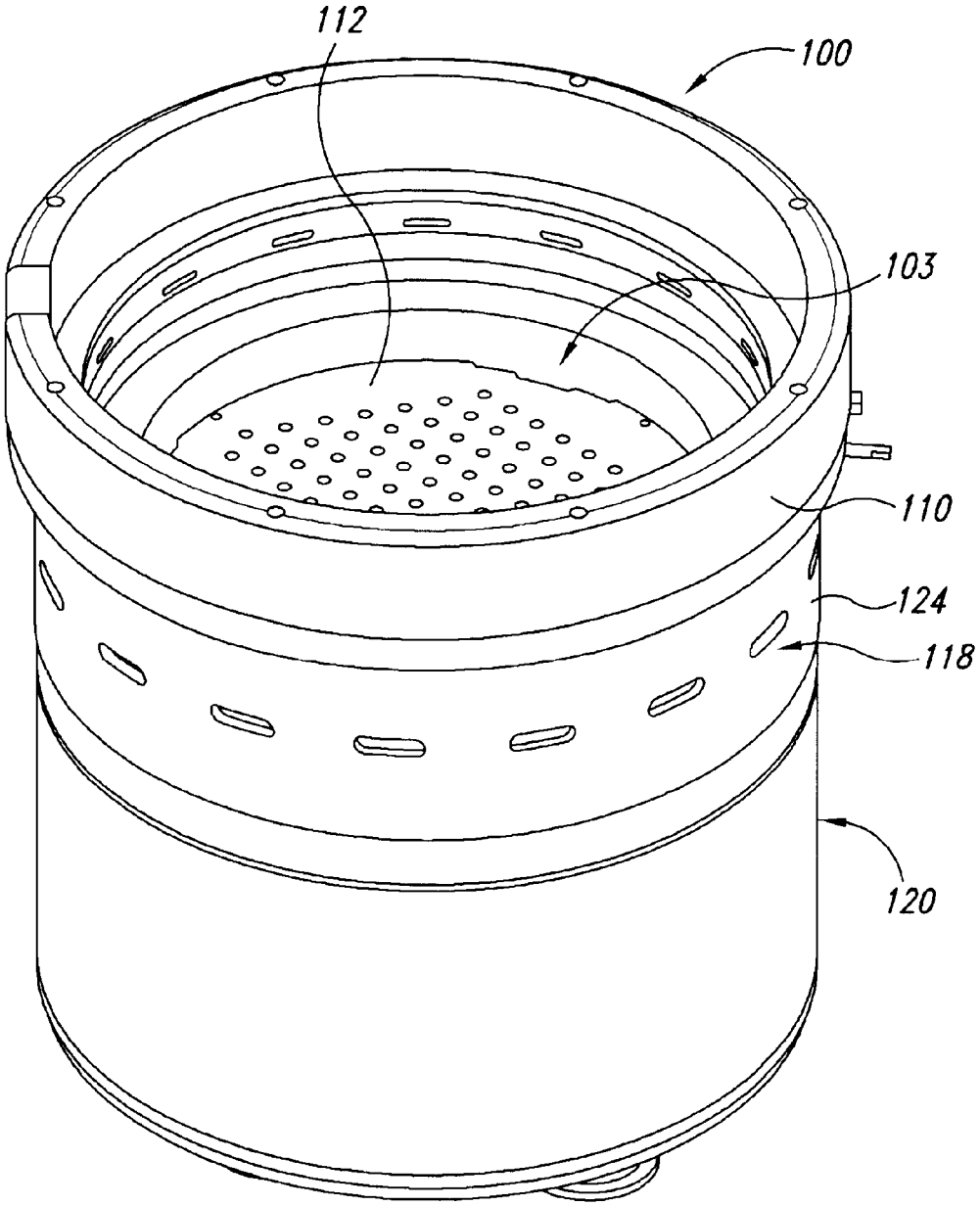
FIG. 2 is a perspective view of a reactor vessel with a diffusion plate.
Figure 3:
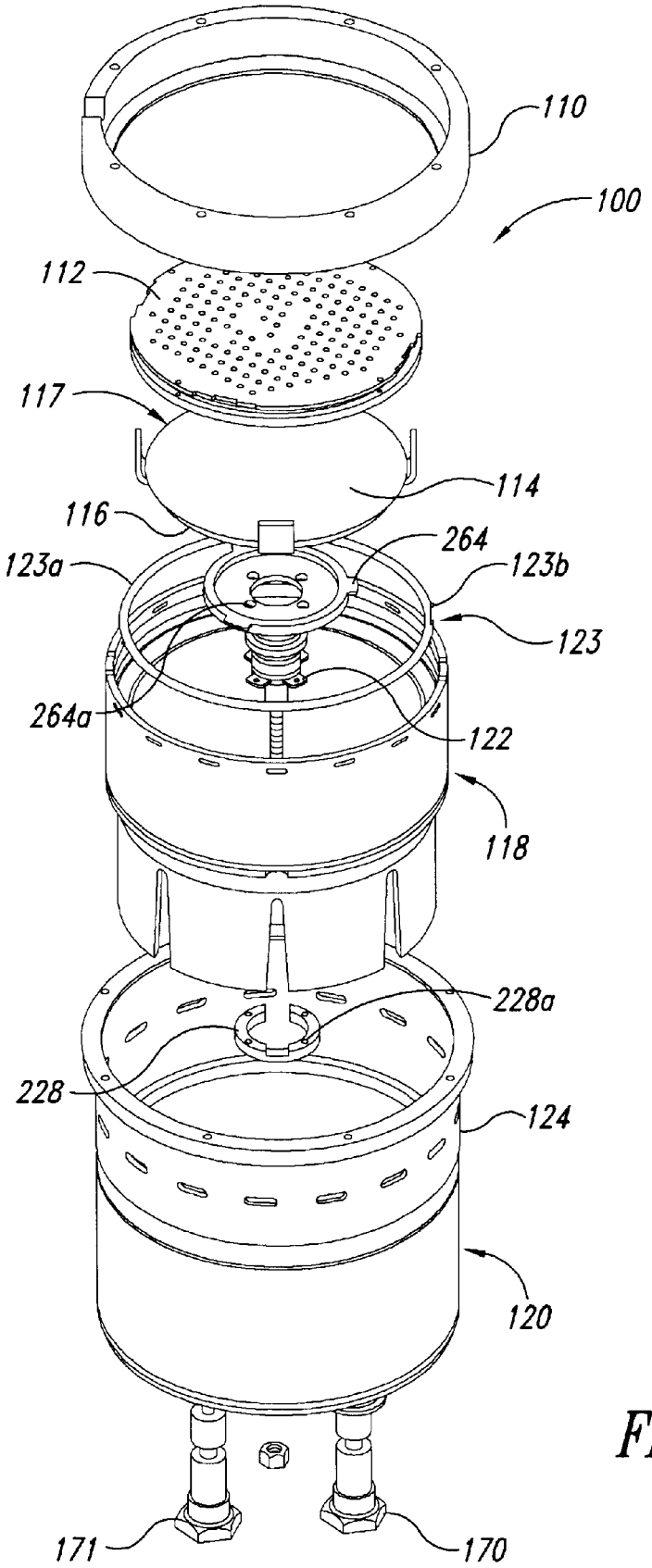
FIG. 3 is an exploded perspective view of the reactor vessel of FIG. 2.
Figure 4:
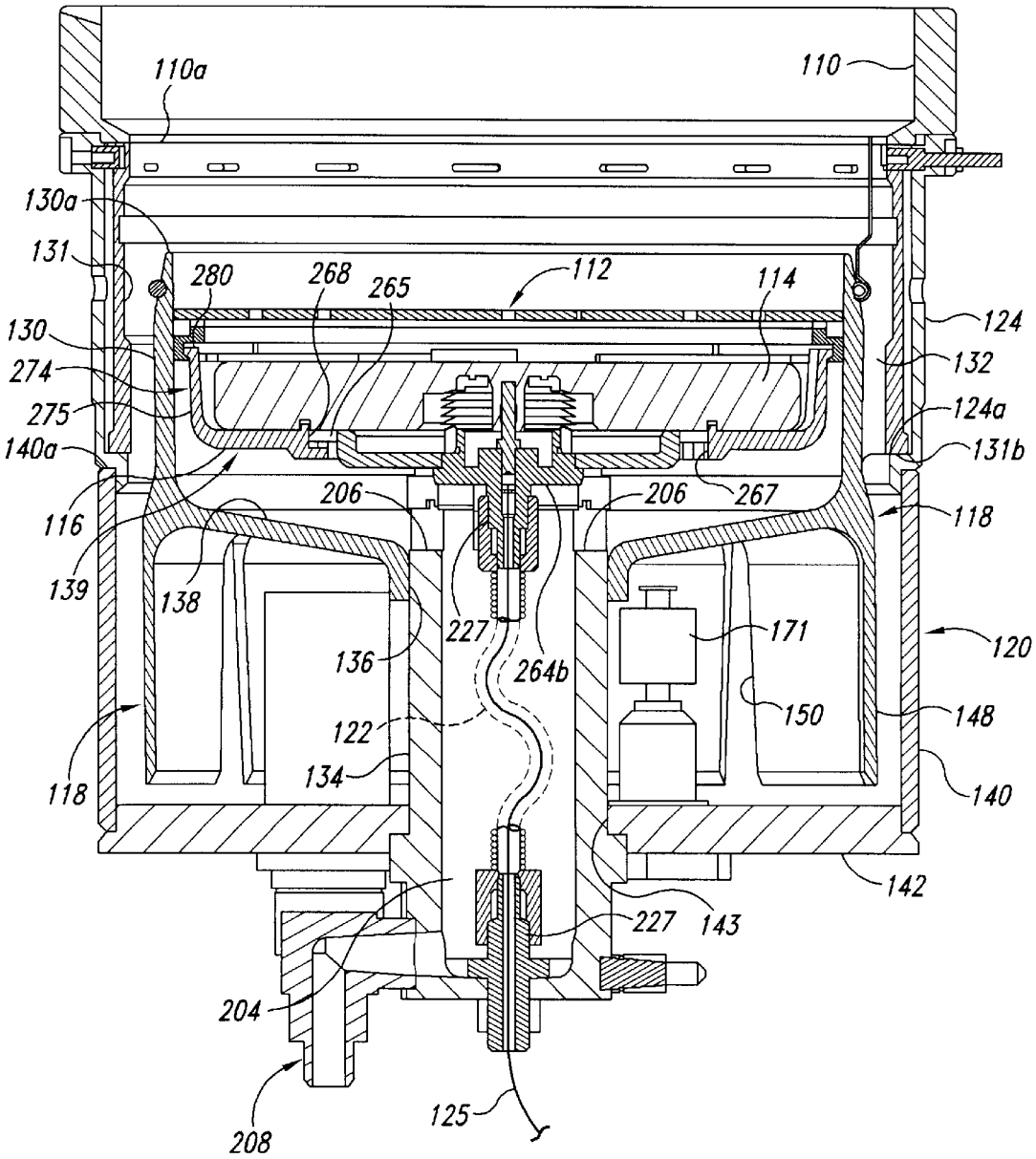
FIG. 4 is a sectional view of the reactor vessel of FIG. 2.

FIGS. 2–4 illustrate a reactor vessel 100 which is to be used in cooperation with a processing head 12 (as shown in FIG. 1). The reactor vessel 100 is described in U.S. Ser. No. 09/112,300, currently pending, filed Jul. 9, 1998, titled "Reactor Vessel Having Improved Cup, Anode and Conductor Assembly", and herein incorporated by reference. The processing head 12 may, for example, be of the type disclosed in U.S. Ser. No. 08/988,333 filed Sep. 30, 1997 entitled: "Semiconductor Plating System Workpiece Support Having Workpiece—Engaging Electrodes With Distal Contact Part and Dielectric Cover" herein incorporated by reference. The processing head holds a wafer to be processed within a substantially closed processing volume 103 of the reactor vessel 100, and rotates the wafer during processing. The vessel 100 is shown without a vessel exhaust ring assembly for clarity to illustrate the underlying parts. It is to be understood that the outer vessel exhaust ring assembly 80 and exhaust nozzle 83 as shown for example in FIG. 1 would be mounted around the vessel 100.

The reactor vessel 100 includes a rotor supporting ring or rim 110 mounted on an inner exhaust ring 124 which is carried on a reservoir container 120. A diffusion plate 112 is carried by an anode shield 116. An anode 114 is carried on the anode shield 116. The anode 114 is preferably a consumable anode composed of copper or other plating material. The anode 114 and the anode shield 116 are fastened together forming an anode assembly 117. A reactor cup assembly 118 is supported on, and partially held within, a reservoir container assembly 120. An anode electrical conductor assembly 122 extends vertically through the reservoir container 120 and includes a sealed conductor 125 (shown schematically as a line) that makes electrical connection with the anode 114.

FIG. 4 illustrates the rotor support ring 110 nesting into the exhaust ring 124 of the reservoir container assembly 120. The cup assembly 118 includes a cup inner sidewall 130 defining at its upper edge 130*a* an overflow weir, and a cup outer sidewall 131 which extends upward to a bottom 110*a* of the rotor support ring 110. The inner and outer sidewalls 130, 131 are radially connected by intermittent webs 132 formed integrally with the sidewalls 130, 131. A container or "cup" 139 for holding process fluid is formed by a cup bottom wall 138 and the inner sidewall 130.

The reservoir container assembly 120 includes a surrounding reservoir sidewall 140 that is sealed to a base plate 142 and supports the exhaust ring 124 at a top thereof The cup assembly 118 is supported by an outer edge 131*b* of the outer sidewall 131 resting on a ledge 124*a* of the exhaust ring 124 which, in turn, supports the top edge 140*a* of the vessel sidewall 140. The entire assembly 100 is supported on a bowl base plate (not shown) by surface 124*b*.

The anode 114 is connected by fasteners (as shown for example in FIG. 1) to the anode shield 116. The anode 114 is supported within the cup sidewall 130 by an anode support structure such as a fluid delivery tube or "anode post" 134. The anode post 134 is in the form of a cylindrical tube having top and bottom ends substantially closed as described below. The anode post 134 extends through an opening 143 through the reservoir base plate 142 and through an opening 136 in the cup bottom wall 138. The anode post 134 is sealed to the cup bottom wall 138 around the opening 136 with an O-ring 137. Further, the anode post is sealed to the base plate 142 around the opening 143 by plastic welding or other sealing technique.

The anode post 134 includes an internal volume 204 in fluid communication with outlet openings 206, and with a bottom supply nozzle 208, for delivering process fluid into the cup 139, from an outside source of process fluid. The anode post 134 is closed at a top end by the bottom surface 264*b* of the anode electrode conductor assembly 122.

Figure 7:
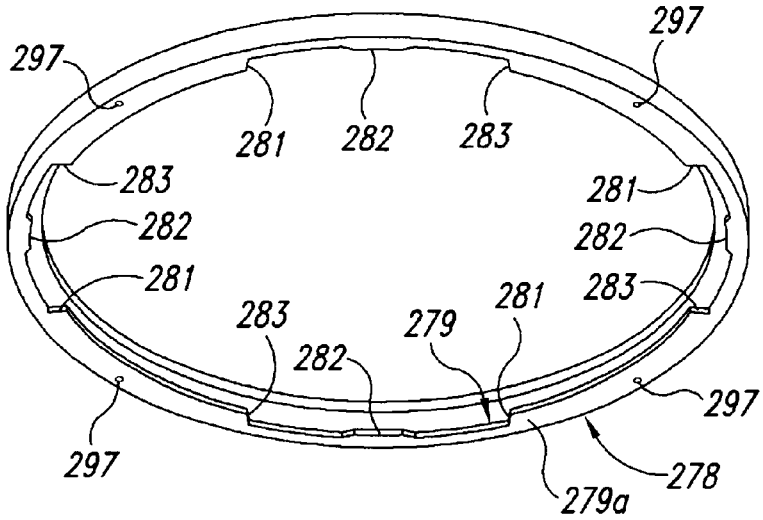
FIG. 7 is a bottom perspective view of one embodiment of a bottom ring portion of the diffusion plate of FIG. 5.

The diffusion plate 112 is connected to intermittently arranged upstanding bracket members 274 using bayonet connections. As shown in FIGS. 4 and 7, a connector ring 278 of the diffusion plate 112 has a C-shaped cross-section forming a channel 279. Each bracket 274 includes a vertical leg 275 and a radially, outwardly extending tab member 280. During installation, each tab member 280 enters a wide slot or recess 281 through the bottom leg 279*a* of the C-shaped cross-section. Upon relative turning between the ring 278 and the bracket 274, each vertical leg 275 of each bracket 274 resiliently passes a detent 282 and enters a more narrow slot or recess 283. Each detent 282 thus resiliently locks a bracket member 274 to the connector ring 278. To remove the diffusion plate 112 from the anode assembly 117, the plate is rotated in an opposite direction. The legs 275 resiliently deflect radially inwardly a sufficient amount to pass the detents 282. Finally, the tab members 280 are withdrawn through the recesses 281.

Figure 5:
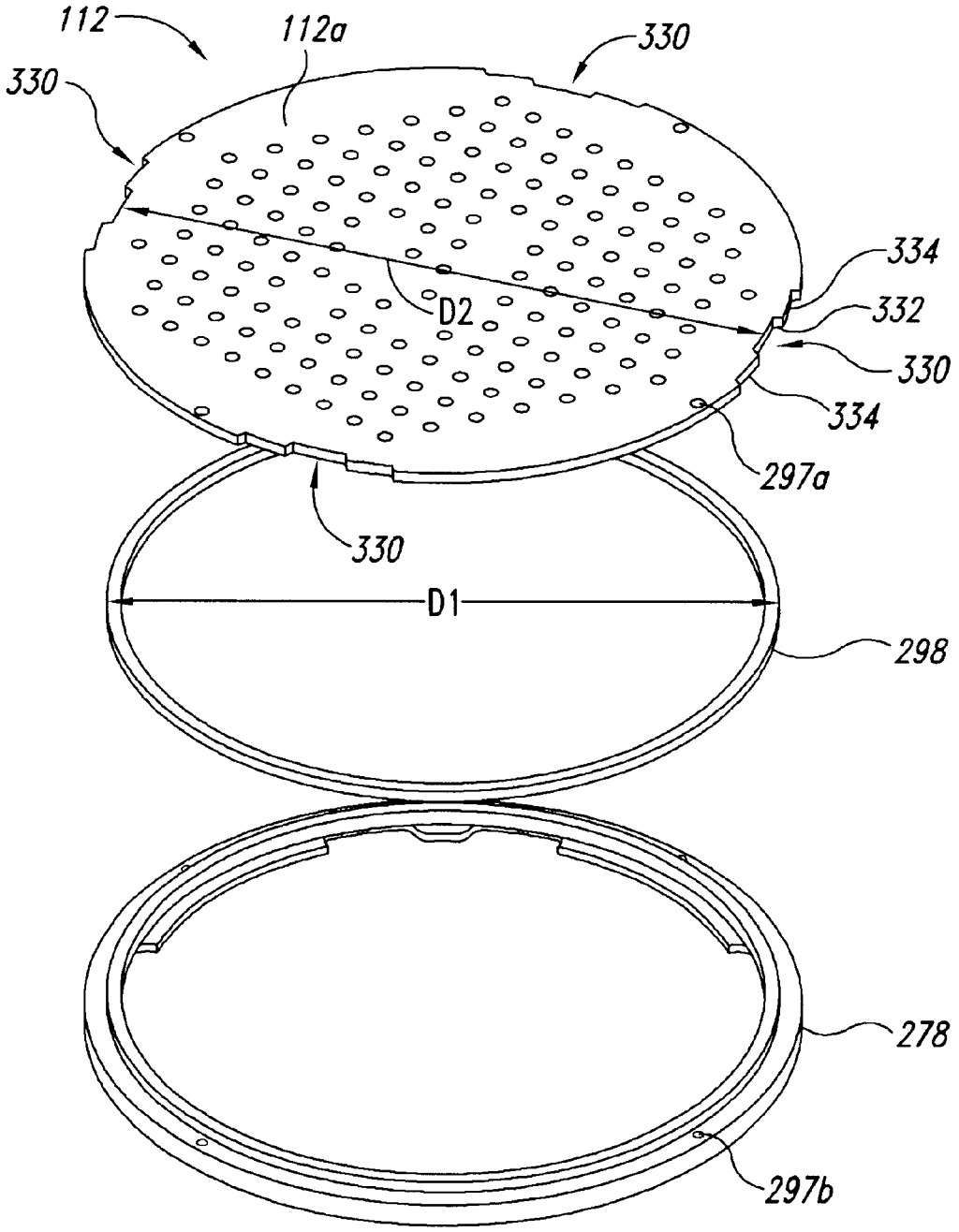
FIG. 5 is an exploded perspective view of one embodiment of a diffusion plate as used in the reactor vessel of FIG. 2.

The diffusion plate 112 can be engaged and removed by a tool described in the aforementioned U.S. Ser. No. 09/112,300, filed Jul. 9, 1998, and herein incorporated by reference. The tool hook arms are configured and arranged to engage bayonet recesses 330 formed through an outside of a top perforated plate 112*a* of the diffusion plate 112 as illustrated in FIG. 5. Each recess 330 includes a wide region 332 for receiving a hook portion, and two narrow regions 334 for snugly receiving a leg of the tool hook arm into a locked position (in either direction depending on whether removal or installation is taking place). When the leg moves in this position, the hook portion is located below the top perforated plate 112*a*. The tool can be turned to rotate the diffusion plate for its removal or installation.

Figure 6:
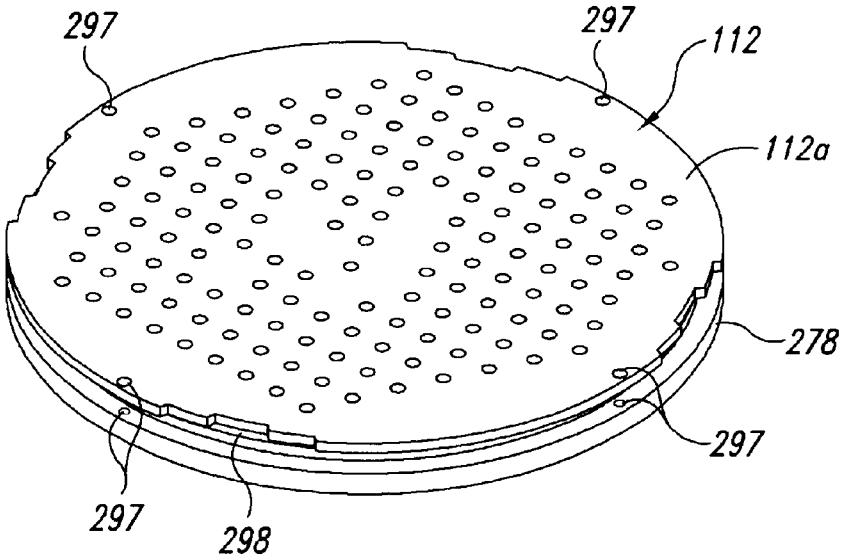
FIG. 6 is a perspective view of the diffusion plate of FIG. 5.

FIGS. 5–7 illustrate the diffusion plate 112 in detail. The diffusion plate includes the top perforated plate member 112*a* which is attached by fasteners (not shown) through four fastener hole pairs 297*a*, 297*b* to the connector ring 278, capturing a spacer ring 298 therebetween. The holes 297*b* are threaded to engage the fasteners. The spacer ring 298 has a smaller outside diameter D1 than an inside diameter D2 between diametrically opposing wide recesses 332 to ensure noninterference of the spacer ring 298 with the hook arms of the removal tool during installation or removal of the diffusion plate. The thickness of the spacer ring 298 provides a vertical space below the perforated plate 112*a*, particularly below the bayonet recesses 330, for a hook portion of the removal tool to be received.

In the disclosed embodiment, the diffusion plate 112 is preferably composed of dielectric materials such as natural polypropylene or polyvinylidene fluoride.

Figure 8:
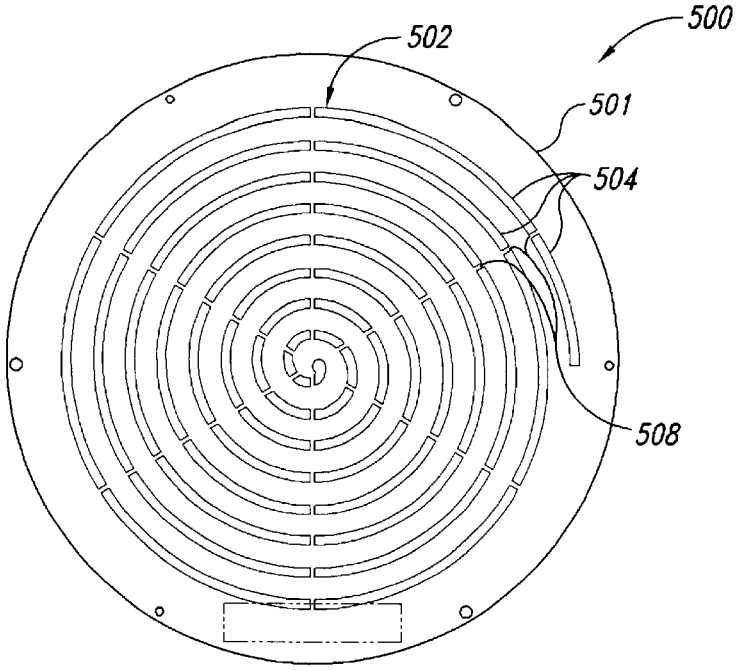
FIG. 8 is a plan view of an alternate embodiment diffusion plate of the invention.

A spiral diffuser 500 having an opening pattern according to the invention is illustrated in FIG. 8. According to this embodiment, the diffuser 500 includes a plate member 501. The plate member 501 includes a spiral opening pattern 502 which "winds" around from an outer circumference to a central area of the plate. The opening pattern 502 is formed by elongated curved slots 504 through the plate member 501. Adjacent slots 504 are separated by a bridge portion 508. The bridge portions 508 throughout the plate member 501 are oriented and aligned radially from the central area to the outer radius of the pattern 502.

The spiral pattern 502 enhances plating fluid flow and current distribution to the wafer face. The diffuser improves plating thickness distribution. The spiral diffuser enables a single diffuser/chamber setup to be used to electroplate wafers having different seed layer edge exclusions.

The spiral pattern diffuser 500 defines a more evenly distributed "% open area" than previous diffusers. The % open area is calculated at radial positions from the plate center outwardly and relates to the open area of the slots compared to the total area of the plate within an infinitesimally thin annular band around the plate, at each radial position. The % open area being calculated in bands around the center of the plate member is important because the wafer is rotated relative to the diffusion plate member, about the center of the plate member. Each open area on the plate member is "swept by" a 360 degree portion of the wafer. The grid type hole patterns, such as shown in FIG. 5 produce a more variable % open area taken across the radius of the plate. This spiral pattern (slot or hole) results in a more uniform distribution of current density. The improved open area distribution of the spiral diffuser results in improved overall plating thickness uniformity, as well as decreasing the thickness range.

Figure 9:
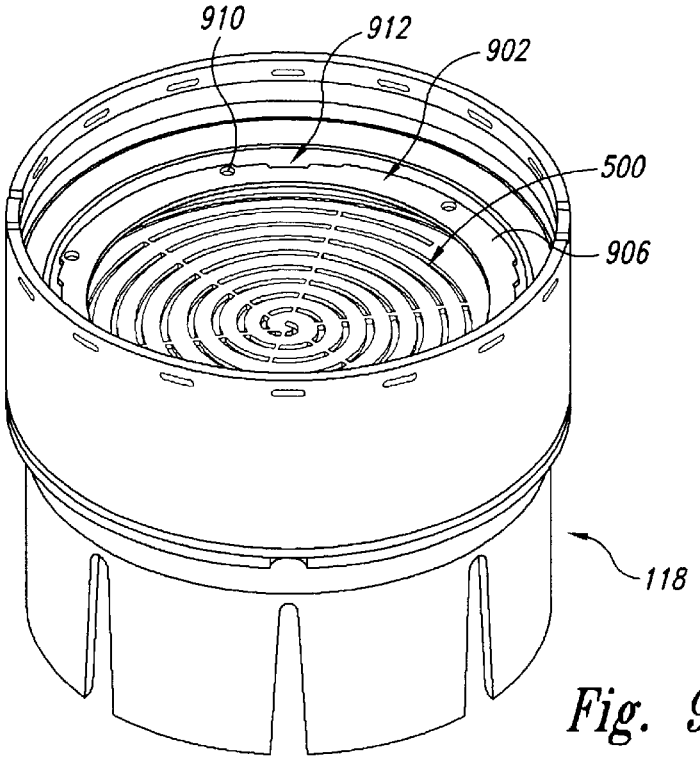
FIG. 9 is a perspective view of a cup assembly, and anode assembly of FIG. 2 which also incorporates the diffusion plate of FIG. 8.

FIG. 9 illustrates the cup assembly 118 which could be used in the reactor vessel shown in FIG. 2. The spiral diffuser 500 as shown in FIG. 8 is mounted into the cup assembly 118. The spiral diffuser 500 is carried by a mounting assembly 902.

Figure 10:
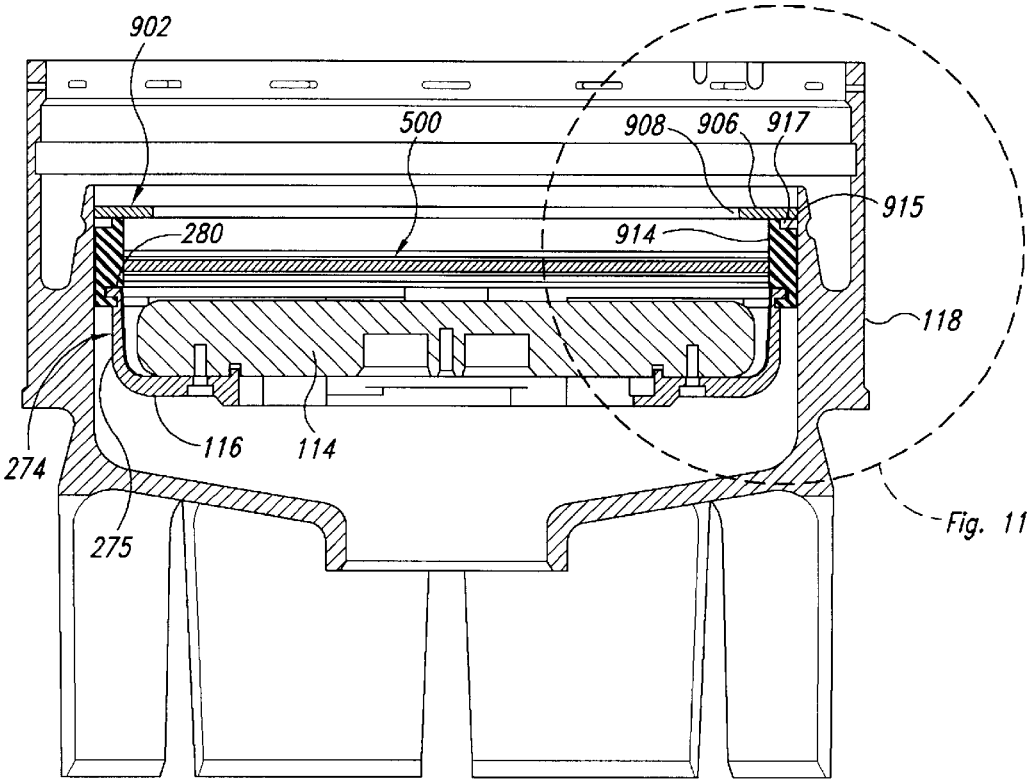
FIG. 10 is a simplified sectional view of the cup assembly, the anode assembly and the diffusion plate of FIG. 9.
Figure 11:
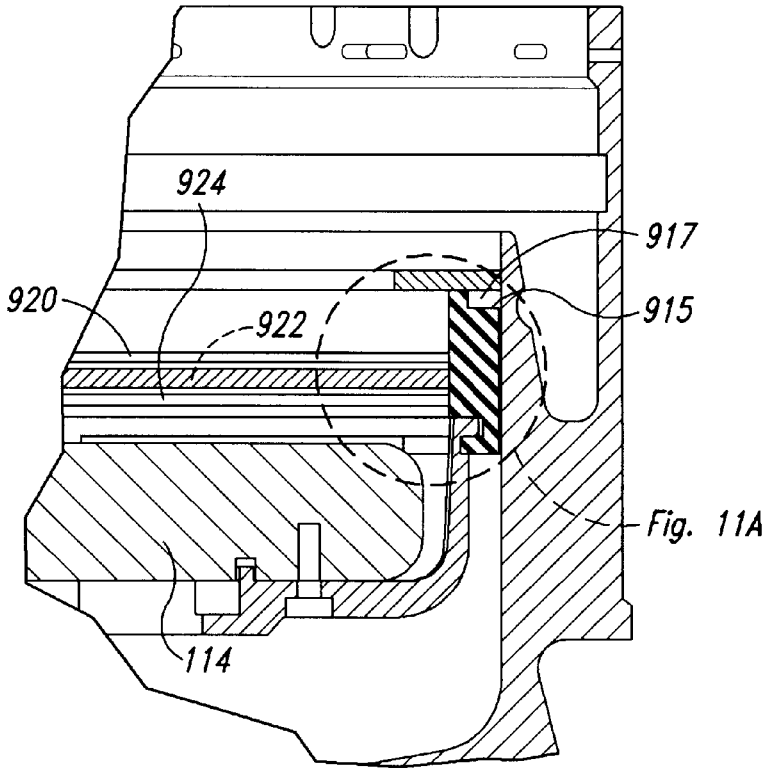
FIG. 11 is an enlarged view taken from FIG. 10.

FIGS. 10 and 11 illustrate the spiral diffuser 500 carried by the mounting assembly 902. The assembly 902 includes a top annular shield 906 having a central opening 908. The shield 908 is fastened by fasteners 910 (shown in FIG. 9) to a mounting ring 914. The mounting ring 914 is connected by a plurality of bayonet style engagements to the brackets 274 of the anode shield 116 in an identical fashion to the engagement of the connector ring 278 to the brackets 274 shown in FIGS. 4–7.

Figure 11A:
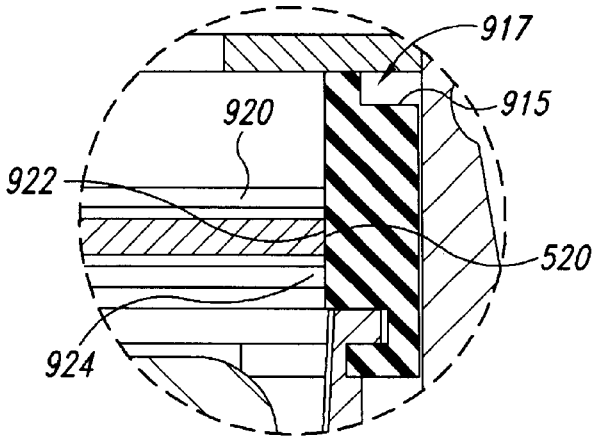
FIG. 11A is an enlarged view taken from FIG. 11.

As shown in FIGS. 9 and 11A, the top shield 906 includes edge recesses 912 identical to those shown in FIG. 5, and described above, as bayonet recesses 330. Below the shield 906, the mounting ring has a step 915 which provides a space 917 for the insertion of the hook portions of the removal tool described above and in the aforementioned U.S. Ser. No. 09/112,300, filed Jul. 9, 1998, and herein incorporated by reference.

As shown in FIGS. 11 and 11A, the diffuser 500 has a rounded edge 520 which can be resiliently engaged to one of a plurality of selectable vertical positions defined by grooves 920, 922, 924. The mounting ring is composed of a relatively resilient material to allow snap-fitting of the diffuser into a selected groove 920, 922, 924. The elevation of the diffusion plate member 501 relative to the top of the cup and the top of the anode is an important process parameter. Thus, by use of the selectable grooves, the height of the plate member can be easily selected corresponding to the selected process parameters.

The diffuser shown in FIG. 5 could likewise be configured to be mounted in accordance with FIGS. 9 through 11A. Alternatively, the diffuser shown in FIG. 8 could be configured to be mounted in an assembly as shown in FIGS. 4 through 7.

The diffuser shown in FIG. 8 can be configured to have tool engagement bayonet recesses 330 such as shown in FIGS. 5 through 6 to be tool engageable for removal and installation. The diffuser shown in FIG. 8 can also be configured to be fastened to the connector ring 278 such as shown in FIGS. 5 through 6 which can then be identically connected to the brackets 274 as described above.

For 200 millimeter wafers, the diffuser plate member 501 shown in FIG. 8 is preferably 8.5 inches in diameter and nominally 0.125 inches thick. Other sizes and thicknesses of diffusers are also encompassed by the present invention.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

What is claimed is:

1. In a reactor for processing a semiconductor wafer, having a vessel, a cup within the vessel for holding a level of process fluid, an anode arranged at a position within the cup, and a wafer support for holding a wafer in the second position spaced from the anode, the improvement comprising:

a diffusion plate member arranged between the anode and the wafer, said diffusion plate member having a plurality of elongated and curved openings arranged in a spiral pattern, at least a major subset of radially adjacent openings of the plurality of elongated and curved openings having substantially identical arc lengths, said wafer support and said diffusion plate member arranged to be rotated relative to each other about a central axis of the spiral pattern.

2. The improvement according to claim 1, comprising a support structure held at an elevation within said vessel, wherein said support structure includes plural alternate mounting locations for said diffusion plate member at different vertical positions with respect to said cup.

3. The improvement according to claim 2 wherein said support structure comprises a mounting ring having a plurality of annular grooves on an inside surface of said mounting ring at incremental elevations for engaging an edge of said diffusion plate member.

4. The improvement according to claim 3, wherein said reactor includes an anode shield mounted below said anode, and said shield includes a plurality of brackets extending upwardly to an elevation above said anode and said mounting ring and said brackets are configured to provide bayonet connections therebetween.

5. The improvement according to claim 3, wherein said diffusion plate member has rounded edges to enhance snap-fitting of said diffusion plate into a selected one of said annular grooves.

6. The improvement according to claim 3, wherein said support structure includes an annular shield overlying said mounting ring and having a central opening smaller than said inside surface of said mounting ring.

7. The improvement according to claim 6, wherein said annular shield includes plural tool engageable recesses for receiving a hook member of a tool from above.

8. A reactor for electroplating a wafer, comprising:

a vessel;

a rotor having wafer holding structure for holding a wafer within said vessel and a rotary device for spinning the wafer;

a cup for holding a supply of process fluids, said cup held within said vessel;

an anode located within said cup and having a top surface and a bottom surface; and a diffusion plate member located between said anode and said wafer holding structure, said diffusion plate member having a plurality of elongated and curved holes arranged in a spiral pattern, at least a major subset of radially adjacent holes having substantially identical arc lengths.

9. The reactor according to claim 8 and further comprising a diffuser support structure held at an elevation within said vessel, wherein said diffuser support structure includes plural alternate mounting locations for said diffusion plate member at different vertical positions with respect to said cup.

10. The reactor according to claim 9, wherein said diffuser support structure includes an annular shield overlying said mounting ring, said annular shield having a central opening smaller than said inside surface of said mounting ring.

11. The reactor according to claim 10, wherein said annular shield includes plural tool engageable recesses for receiving a hook member of a tool.

12. The reactor according to claim 9 wherein said diffuser support structure comprises a mounting ring having a plurality of annular grooves on an inside surface of said mounting ring at incremental elevations for engaging an edge of said diffusion plate member.

13. The reactor according to claim 12, wherein said diffusion plate member comprises rounded edges that facilitate snap-fitting of said diffusion plate into a selected one of said annular grooves.

14. The reactor according to claim 8, wherein said reactor further comprises an anode shield mounted below said anode, said shield comprising a plurality of brackets extending beyond said anode, said mounting ring and said brackets being configured to form a bayonet connection therebetween.

15. In a reactor for processing a semiconductor wafer, having a vessel, a cup within the vessel for holding a level of process fluid, an anode arranged at a position within the cup, and a wafer support for holding a wafer in the second position spaced from the anode, the improvement comprising:

a diffusion plate member arranged between the anode and the wafer, said diffusion plate member having a plurality of openings arranged in a spiral pattern, said wafer support and said diffusion plate member arranged to be rotated relative to each other;

a support structure held at an elevation within said vessel, said support structure having plural alternate mounting locations for said diffusion plate member at different vertical positions with respect to said cup, said support structure further comprising a mounting ring having a plurality of annular grooves on an inside surface of said mounting ring at incremental elevations for engaging an edge of said diffusion plate member.

16. The improvement according to claim 15, wherein said support structure includes an annular shield overlying said mounting ring and having a central opening smaller than said inside surface of said mounting ring.

17. The improvement according to claim 16, wherein said annular shield includes plural tool engageable recesses for receiving a hook member of a tool from above.

18. The improvement according to claim 15, wherein said diffusion plate member has rounded edges to enhance snap-fitting of said diffusion plate into a selected one of said annular grooves.

19. The improvement according to claim 15, wherein said reactor includes an anode shield mounted below said anode, and said shield includes a plurality of brackets extending upwardly to an elevation above said anode and said mounting ring and said brackets are configured to provide bayonet connections therebetween.

* * * * *

UNITED STATES PATENT AND TRADEMARK OFFICE

CERTIFICATE OF CORRECTION

PATENT NO. : 6,254,742 B1
DATED : July 3, 2001
INVENTOR(S) : Hanson et al.

It is certified that error appears in the above-identified patent and that said Letters Patent is hereby corrected as shown below:

Column 4,
Line 48, should read "BRIEF DESCRIPTION OF THE SEVERAL VIEWS OF THE DRAWINGS";

Column 5,
Line 64, insert a period after "thereof";

Column 8,
Line 34, "in the" should be -- at a --;
Line 42, "having" should be -- extending circumferentially through --;
Line 42, "arc lengths" should be -- angles --;

Column 9,
Line 11, "fluids" should be -- fluid --;
Line 20, "having" should be -- extending circumferentially through --;
Line 21, "arc lengths" should be -- angles --;

Column 10,
Line 10, "in the" should be -- at a --;
Line 15, insert -- therethrough said openings -- after "openings";
Line 17, insert -- and -- after "other";

Signed and Sealed this

Twenty-eighth Day of May, 2002

*Attest:*

*Attesting Officer*

JAMES E. ROGAN
*Director of the United States Patent and Trademark Office*